United States Patent [19]

Rollband et al.

[11] 4,242,795

[45] Jan. 6, 1981

[54] KNIFE HANDLE

[75] Inventors: Ernest J. Rollband, Brooktondale, N.Y.; Robert F. West, West Simsbury, Conn.

[73] Assignee: The Stanley Works, New Britain, Conn.

[21] Appl. No.: 8,877

[22] Filed: Feb. 2, 1979

[51] Int. Cl.[3] ..... B26B 1/08; B26B 5/00

[52] U.S. Cl. ..... 30/162; 30/320

[58] Field of Search ..... 30/162, 320, 293, 125

[56] References Cited

U.S. PATENT DOCUMENTS

| | | | |
|---|---|---|---|
| 3,192,624 | 7/1965 | Gringer | 30/162 |
| 3,316,635 | 5/1967 | Merrow | 30/162 |
| 4,005,525 | 2/1977 | Gringer | 30/162 |
| 4,028,758 | 6/1977 | O'Conner | 30/162 |
| 4,063,356 | 12/1977 | Hepworth | 30/320 X |

*Primary Examiner*—Jimmy C. Peters

*Attorney, Agent, or Firm*—Prutzman, Kalb, Chilton & Alix

[57] ABSTRACT

An elongated knife handle is provided with a blade carrier with a thumb button extending through a longitudinal top slot in the handle and is depressed for manipulating and latching the blade carrier in its sheathed and unsheathed positions. An integral upstanding abutment which extends higher than the thumb button is provided adjoining the forward end of the top slot and extends rearwardly along both sides of the forward end of the top slot to form a recess in which the thumb button is nested when it is in its forward or operating position to prevent the accidental unlatching of the blade carrier during heavy cutting operations.

3 Claims, 7 Drawing Figures

KNIFE HANDLE

This invention relates to knife handles and more particularly to a knife handle for a utility knife in which the blade may be slidably moved from a sheathed position in which it is stored within the handle and an extended unsheathed position.

A typical knife handle of this type is described in greater detail in U.S. Pat. No. 3,107,426 issued to W. H. Robinson, Jr. on Oct. 22, 1963 and entitled "Utility Knife." Such a knife incorporates a blade carrier which supports the blade and incorporates a thumb actuated button that can be depressed to unlatch the blade from one of several latched positions and shifted to another position. The thumb actuated button extends through a slot in the top of the knife handle and is secured to the blade carrier by means of a resilient finger. Such knives are of great utility in a wide variety of cutting operations. It has been found, however, that knives of the type described, are sometimes subject to the inadvertent or unintentional activation of the thumb adjusting button particularly when heavy pressure is applied during the cutting operation. Efforts to solve this problem have been made and one solution is described in U.S. Pat. No. 3,888,002, issued to J. J. Graham, on June 10, 1975. In the design disclosed in that patent, the thumb button is rotated so that it straddles the slot through the top of the knife handle and cannot be depressed.

The present invention is intended to provide a different solution to the problem and one which is extremely durable, can be inexpensively incorporated in existing knife handle designs without requiring extensive changes therein and does not involve any moving parts.

One way of carrying out the invention is described below with reference to the drawings which illustrates a specific embodiment in which.

Figure 1:
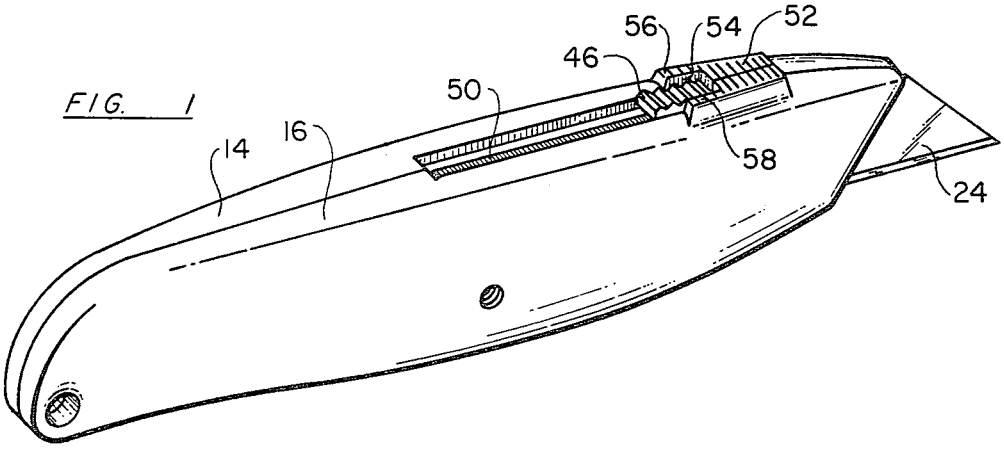
FIG. 1 is a perspective view of a knife handle incorporating the present invention.

As more fully described in the aforesaid U.S. Pat. No. 3,107,426, the knife handle comprises a pair of mating handle members or halves 14, 16 which are assembled to form a hollow interior provided with guide ways 18, 20 for slidably mounting a generally planar blade carrier 22 for rectilinear movement into and out of an opening 23 at the front end of the handle. The blade carrier 22 in turn mounts a blade 24 which is nested between the flanges 26, 28 of the blade carrier and is retained in a fixed longitudinal position on the blade carrier by a tab 30 which engages a notch 32 in the edge of the blade.

As shown, an integral resilient finger 34 extends rearwardly of the planar blade supporting portion of the blade carrier 22, and provides an upwardly turned end forming a latching tab 36 which is adapted to be received in any one of the notches 38, 40, 42, 44, to latch the blade carrier and the blade in a selected sheathed or unsheathed position. A thumb button 46 is connected to the resilient finger 34 by a neck 48 which extends through a longitudinal slot 50 in the top of the handle and is conveniently accessible for thumb actuation. It will readily be seen that the longitudinal position of the blade carrier 22 may be adjusted by depressing the thumb button 46 to unlatch the latching tab 36 and shifting the blade carrier longitudinally with respect to the handle.

As previously stated, the thumb button 46 is exposed so that it is readily accessible for adjusting the blade carrier and as such may be accidentally depressed particularly when heavy pressure is being applied during the cutting operation.

In accordance with this invention, means are provided to prevent such inadvertent pressure from being applied to the thumb button while at the same time retaining the accessibility of the thumb button for the intentional manipulation of the blade carrier.

Figure 2:
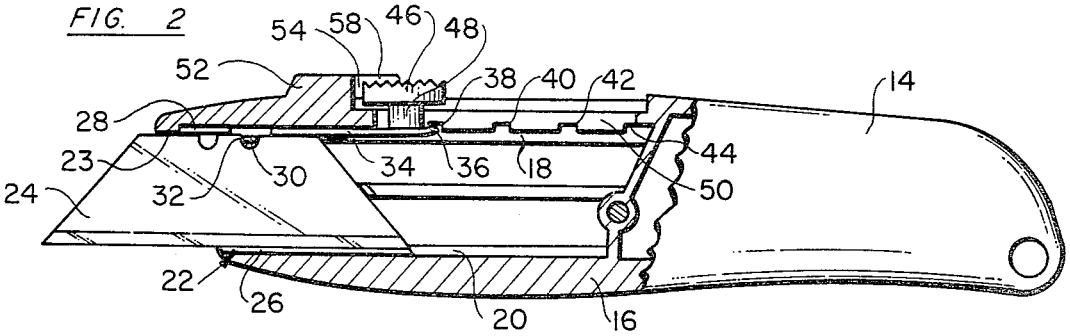
FIG. 2 is a side elevational view of the knife handle of FIG. 1, partly broken away and partly in section.

As shown in FIGS. 1 and 2, an upstanding abutment 52 which extends higher than the top surface of the thumb button 46 is formed integrally with the handle halves at the forward end of the slot 50. The abutment 52 provides a recess 54 defined by sidewalls 56, 58 of the abutment which overlap the forward end of the slot 50 so that button 46 may be nested in the recess 54 when the blade 24 is in its unsheathed or operating position. Thus the abutment 52 shields the thumb button 46 during the cutting operation when heavy pressure might be applied.

In accordance with the preferred embodiment of the invention, the sidewalls 56, 58 of the abutment 52 extend a distance so that approximately half of the thumb button 46 is nested in the recess 54, and shielded by the abutment 52 with the rear half of the thumb button 46 being exposed for manipulation as required to retract the blade into the knife handle.

Figure 4:
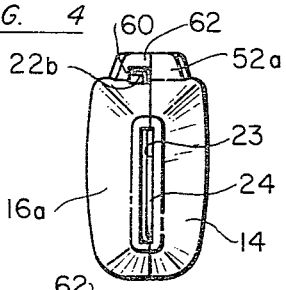
FIG. 4 is a front end view of the knife of FIG. 3.
Figure 5:
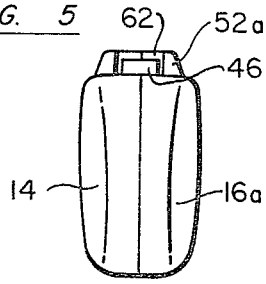
FIG. 5 is a rear end view thereof.
Figure 3:
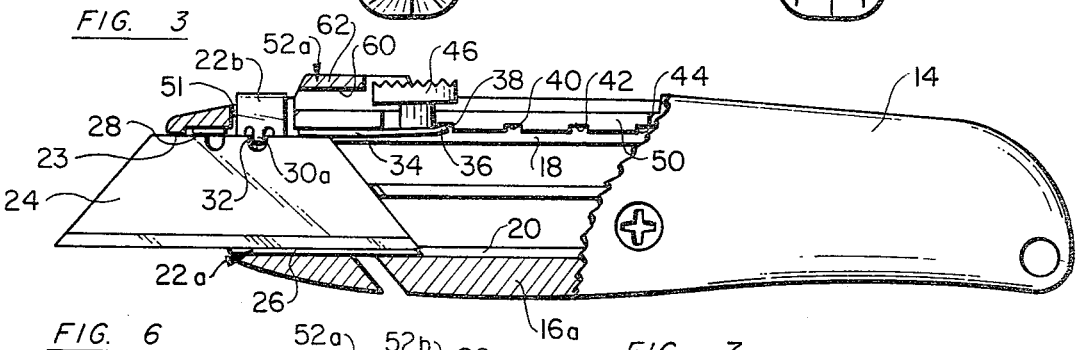
FIG. 3 is a view similar to FIG. 2 showing a modified form of the invention.
Figure 6:
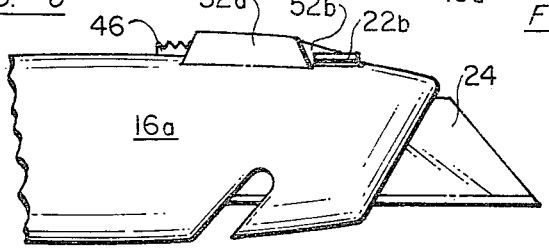
FIG. 6 is a fragmentary side elevational view of another modified form of the invention.
Figure 7:
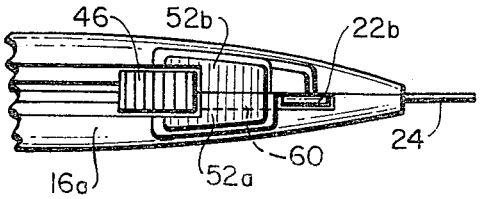
FIG. 7 is a fragmentary top plan view of the knife handle of FIG. 6.

The modified design of FIGS. 3–5 is one wherein the planar blade support portion of blade carrier **22*a* is provided with a flexible upstanding arm 22*b* mounting a tab 30*a* which secures the blade 24 longitudinally of the blade carrier. In this design, the handle half 16*a* is provided with a lateral recess 51 so that, when the blade carrier is in its forward position, the arm 22*b* may be deflected sideways into the recess 51 to disengage tab 30*a* from notch 32 of the blade for the removal of the blade from the blade carrier 22*a* as more fully disclosed in U.S. Pat. No. 3,577,637, issued to P. A. Braginetz on May 4, 1971. In this design, the upstanding abutment is provided with a longitudinal tunnel 60 formed by a bridging flange 62 of the abutment 52*a* on handle half 16*a*. This construction permits the arm 22*b* to pass through the tunnel 50 from its most forward position as shown in FIG. 3, wherein the blade is unsheathed for use or replacement to its rearward position wherein the blade is sheathed or stored within the handle without diminishing the surface area of the abutment for receiving thumb pressure during cutting operations and without reducing the shielding effect of abutment 52*a*. FIGS. 6 and 7 disclose a form of the invention similar to that of FIGS. 3–5**.

In this embodiment, the handle halves provide a pair of abutment portions **52*a* and 52*b*. Abutment portion 52*a* provides a tunnel 60 for the passage of arm 22*b* of blade carrier 22*a* so that the blade carrier can extend the blade to its unsheathed position in the same manner as in FIG. 3. However, in this form of the invention, the abutment portion 52*b* extends forwardly of the abutment portion 52*a* to overlap arm 22*b* when arm 22*b* is in its forward position, and extends higher than arm 22*b*** to shield arm 22*b* when cutting pressure is applied to the handle.

As can be seen from the foregoing detailed description, the present invention provides a simple, durable, inexpensive, yet effective arrangement for preventing the unintentional unlatching of the blade carrier during use, while at the same time retaining the requirements of accessibility of the thumb button for the rapid manipulation of the blade into a stored or sheathed position. It is further apparent that the invention provides a finger rest construction which can readily be incorporated into existing knife handle designs without requiring extensive changes therein.

We claim:

1. An elongated knife handle having a blade opening at the forward end thereof, a blade carrier within said handle for mounting a blade for longitudinal movement between a sheathed position in which it is stored in the handle and an extended unsheathed position, and a longitudinal slot extending along the top of the handle in general alignment with the longitudinal plane passing through said blade opening, said blade carrier including a latching member providing a thumb button extending through said top slot for manipulation of the blade carrier between its sheathed and unsheathed positions, the improvement wherein an integral upstanding abutment is provided on the top of the handle adjoining the forward end of the top slot, said abutment extending higher than said thumb button to shield the thumb button from inadvertent pressure when the thumb button is positioned at the forward end of the slot with the blade in its unsheathed position and manual pressure is applied to the handle during cutting operations, the carrier having a flexible upstanding arm which extends through said top slot forwardly of the thumb piece, said arm including means for securing the blade on the blade carrier, said handle providing a forward extension to the top slot for receiving the flexible arm when the blade is in its unsheathed position and a lateral recess for receiving the flexible arm when it is deflected laterally removed the blade, and said abutment being longitudinally tunneled to permit the arm to pass under the abutment.

2. The knife handle of claim 1 wherein the abutment has a forward extension extending along the side of the forward extension to the top slot opposite the lateral recess.

3. An elongated knife with an elongated handle having a blade opening at the forward end thereof, a knife blade carrier mounted within said handle for longitudinal movement between a retracted blade sheathed position at which a blade mounted thereon is sheathed by the handle and a forward blade unsheathed position at which the blade extends through the blade opening for cutting, and a longitudinally extending slot opening extending along the top of the handle, said blade carrier having a latching member for latching the carrier in its extending position against retraction and thumb button extending through said slot opening for being depressed from a normal raised position thereof for unlatching the carrier and for manipulating the blade carrier between its retracted and extended positions, the improvement wherein the handle has an integral upstanding generally U-shaped and rearwardly opening abutment on the top of the handle at the forward end of said slot opening, said abutment having an upper thumb engageable surface extending rearwardly along both sides of a forward part only of the thumb button in the said forward position of the blade carrier to shield the thumb button from being inadvertently depressed and the blade carrier from being inadvertently retracted from its extended position by a thumb on the thumb button when manual pressure is applied during a cutting operation.

* * * * *

UNITED STATES PATENT AND TRADEMARK OFFICE

CERTIFICATE OF CORRECTION

PATENT NO. : 4,242,795

DATED : January 6, 1981

INVENTOR(S) : Ernest J. Rollband and Robert F. West

It is certified that error appears in the above-identified patent and that said Letters Patent are hereby corrected as shown below:

In Column 2, line 51--"50" should be "60".
Column 4, line 3--after "laterally", insert "to".
Column 4, line 4--"removed" should be "remove".
Column 4, line 21--"extending" should be "extended".

Signed and Sealed this

*Seventh* Day of *April 1981*

[SEAL]

*Attest:*

RENE D. TEGTMEYER

*Attesting Officer* *Acting Commissioner of Patents and Trademarks*